US006076983A

United States Patent [19]

Stein et al.

[11] Patent Number: 6,076,983

[45] Date of Patent: Jun. 20, 2000

[54] METHOD AND APPARATUS FOR PRINTING ONTO A CONTINUOUSLY ADVANCING WEB OF WORK MATERIAL

[75] Inventors: Darryl Colburn Stein, Andover; A. Bruce Plumley, Middletown, both of Conn.

[73] Assignee: Gerber Technology, Inc., Tolland, Conn.

[21] Appl. No.: 09/245,617

[22] Filed: Feb. 5, 1999

Related U.S. Application Data

[63] Continuation-in-part of application No. 09/166,314, Oct. 5, 1998.

[51] Int. Cl.[7] ..... B41J 11/00

[52] U.S. Cl. ..... 400/611; 400/120.16; 400/120.17; 347/37

[58] Field of Search ..... 400/611, 120.16, 400/120.17; 347/37, 104, 218

[56] References Cited

U.S. PATENT DOCUMENTS

| | | | |
|---|---|---|---|
| 3,742,846 | 7/1973 | Knappe | 101/93.05 |
| 4,839,741 | 6/1989 | Wilson | 358/404 |
| 5,838,346 | 11/1998 | Stemmle, Sr. | 347/37 |

FOREIGN PATENT DOCUMENTS

| | | | |
|---|---|---|---|
| 3-33609 | 9/1989 | European Pat. Off. | 347/37 |
| 0 881 820 A2 | 12/1998 | European Pat. Off. . | |
| 2-292047 | 12/1990 | Japan | 347/37 |
| 6-198867 | 7/1994 | Japan | 347/37 |

*Primary Examiner*—John S. Hilten
*Assistant Examiner*—Daniel J. Colilla
*Attorney, Agent, or Firm*—McCormick, Paulding & Huber LLP

[57] ABSTRACT

In an apparatus for printing on a web of work material continuously advanced in an X coordinate direction at a velocity $v_{wx}$, at least one print head having a plurality of print elements arranged in a scanning array extending in the X direction is repetitively movable relative to the apparatus. The scanning array moves at a velocity $v_a$ along a path that includes at least one scan segment and at least one repositioning segment. As the scanning array traverses the scan segment it has a first velocity component $v_{ax}$ in the X direction, and a second velocity component $v_{ay}$ in a Y direction perpendicular to the X direction. The first velocity component $v_{ax}$ is equal to the velocity $v_{wx}$ so that the scanning array in traversing the scan segment, scans a swath on the web parallel to the Y direction, having a swath height $h_s$. The velocity component $v_{ay}$ is such that in the time taken for the array to move along the full extent of the scan segment the web advances a distance $h_w$ in the X direction that is less than $h_s$. The array then travels along the repositioning segment such that prior or equal to a time taken for the web to advance a distance $d=h_s-h_w$ the print head is positioned for movement along the scan segment, thereby causing successive swaths of the web scanned by the array to be positioned immediately adjacent to one another.

22 Claims, 9 Drawing Sheets

METHOD AND APPARATUS FOR PRINTING ONTO A CONTINUOUSLY ADVANCING WEB OF WORK MATERIAL

CROSS REFERENCE TO RELATED APPLICATIONS

This application is a continuation-in-part of U.S. patent application Ser. No. 09/166,314 filed on Oct. 5, 1998 by inventors Plumley and Stein.

FIELD OF THE INVENTION

The present invention is generally related to printing on sheet-type work materials, and is more specifically directed to a device for, and method of, printing graphics onto sheet material as it is advanced in an uninterrupted motion through the device.

BACKGROUND OF THE INVENTION

When printing a graphic onto a sheet of work material using known printing devices, the work material is typically advanced through the device in a step-by-step manner with the advancement being momentarily halted between each step. In general, between each step a print-head traverses the work material in a direction perpendicular to the direction of the work material's advancement and transfers a swath of print media such as ink onto the work material in accordance with the graphic being printed. This process is repeated causing successive swaths of ink to be transferred onto the work material immediately adjacent to one another with each pass of the print head.

A problem associated with advancing the work material through the printing device in the above-described step-by-step manner is that the time required to print a graphic can be quite long. This is particularly true where large, and/or complex graphics are concerned. Furthermore, in a production setting, these long print times translate into increased cost, as well as in reductions in printer throughput. Accordingly, there is a present need for printing and plotting devices able to produce graphics in shorter periods of time than is currently possible.

Another difficulty associated with the step-by-step advancement of the work material occurs where the work material is a web fed from a roll. In general, a significant amount of force is required to initiate advancement of the web via rotation of the roll. Similarly, the roll's inertia makes a sudden smooth stop difficult. This sometimes results in the generation of shock pulses in the web of work material which have the potential to detrimentally affect the quality of the graphic being printed.

Based on the foregoing, it is a general object of the present invention to provide an apparatus and method for printing graphics onto work material that overcomes the drawbacks and difficulties associated with prior art devices.

It is a more specific object of the present invention to provide a printing device whereby the advancement of the work material, through the device, and the motion of the print head when traversing and printing on the work material, are synchronized such that the work material is continuously advanced through the device in an uninterrupted motion.

SUMMARY OF THE INVENTION

The present invention is directed to an apparatus for printing on a continuously advancing web of work material that includes a frame, as well as means for continuously advancing the web through the apparatus in an X coordinate direction longitudinally of itself at a velocity $v_{wx}$ relative to the frame. At least one print head for printing a graphic onto the continuously advancing web is coupled to the frame for movement relative thereto and includes a plurality of print elements positioned adjacent to the web and arranged in a source array extending in the X coordinate direction.

Means are provided for repetitively moving the source array relative to the frame along a path having at least one scan segment and one repositioning segment. During operation, the source array traverses the scan segment at an overall velocity $v_a$ defined by a first velocity component $v_{ax}$ in the X coordinate direction, equal to the web velocity $v_{wx}$, and a second velocity component $v_{ay}$ in a Y coordinate direction perpendicular to the X coordinate direction. As a result of the first velocity component $v_{ax}$ being equal to the web velocity $v_{wx}$ the source array in traversing the scan segment of the path scans a swath on the web parallel to the Y coordinate direction and having a swath height $h_s$. The second velocity component $v_{ay}$ is such that in the time required to move the source array along the full extent of the scan segment of the path the web advances a distance $h_w$ in the X coordinate direction that is less than the swath height $h_s$ scanned by the source array in traversing the scan segment.

Once the source array has fully traversed the scan segment, the means for repetitively moving the source array causes the array to travel along the repositioning segment. This motion is accomplished in a time period shorter than, or equal to the time taken for the web to advance a distance d, where $d=h_s-h_w$. In this manner, the source array is repositioned for immediate movement along a scan segment, thereby causing successive swaths of said web scanned by the source array to be positioned on the continuously advancing web immediately adjacent to one another.

The above-described path along which the source array travels can assume different configurations. For example, in one configuration the source array travels along a scan segment transversely across the continuously advancing web. During this motion, the velocity of the array comprises the first and second velocity components described hereinabove. Once the array has fully traversed the scan segment, it immediately moves along the repositioning segment, which, in this instance mirrors the scan segment. Accordingly, the source array travels back-and-forth along the same path. However, the array must move along the repositioning segment in a time less than or equal to the time it takes for the web to advance the distance "d" in order for successive swaths of the web scanned by the source array to be positioned immediately adjacent to one another perpendicular to the X coordinate direction.

The source array can also follow a figure-8-shaped path relative to the frame. To accomplish this the source array must travel along a first scan segment having first and second ends, and a second scan segment having third and forth ends, each scan segment extending transversely across the web. Preferably, the third and fourth ends of the second scan segment are adjacent to the second and first ends respectively, of the first scan segment. A first repositioning segment extends between the second end of the first scan segment and the third end of the second scan segment. In addition, a second repositioning segment extends between the first end of the first scan segment and the fourth end of the second scan segment.

As the source array traverses the figure-8-shaped path it initially traverses the first scan segment of the path from the first to the second end at a velocity having a first velocity component $v_{1ax}$ in the X coordinate direction equal to the velocity of the web $v_{wx}$, and a second velocity component $v_{1ay}$ in the Y coordinate direction. Accordingly, the source array scans a first swath on the web parallel to the Y coordinate direction having a first swath height $h_{1s}$.

As the source array traverses the first scan segment, the second velocity component $v_{1ay}$ is such that in the time required for the array to traverse the full extent of the first scan segment, the web advances a distance $h_{1w}$ in the X coordinate direction that is less than the swath height $h_{1s}$. Upon traversing the full extent of the first scan segment the source array next traverses the first repositioning segment in a time less than or equal to the time taken for the web to advance a distance $d_1$, where $d_{1s}=h_{1s}-h_{1w}$. The print head is now positioned for immediate movement along the second scan segment.

The source array next traverses the second scan segment at a velocity $-v_a$ defined by a first velocity component $v_{2ax}$ in the X coordinate direction equal to the velocity of the web $v_{wx}$, and a second velocity component $-v_{2ay}$. In traversing the second scan segment, the source array scans a second swath on the web parallel to said Y coordinate direction, having a second swath height $h_{2s}$. Moreover, the velocity component $-v_{2ay}$ is such that in the time required for the scanning array to traverse the full extent of the second scan segment the web advances the distance $h_{2w}$ in the X coordinate direction which is less than the second swath height $h_{2s}$.

Accordingly, upon traversing the full extent of the second scan segment the source array travels along the second repositioning segment in a time less than or equal to the time taken for the web to advance a distance $d_2$, where $d_2=h_{2s}-h_{2w}$. In this manner the print head is once again positioned for immediate movement along the first scan segment, such that the path traced by the source array is figure -8-shaped relative to the frame. The source array scans two successive swaths of said continuously advancing web immediately adjacent to one another and parallel to the Y coordinate direction, with each traverse of the figure-8-shaped path.

The print head can also be configured to include an array of discrete printing elements wherein the total number of printing elements is referred to as the source array, from which a "scanning array" is selected. During operation as the print head traverses the web along a scan segment, groups of printing elements comprising the scanning array are selectively and progressively activated causing the scanning array to have the velocity component $v_{ax}$, relative to the frame in the X coordinate direction equal to the web velocity $v_{wx}$. This results in the scanning of swaths on the work material perpendicular to the Y coordinate direction.

In an alternate embodiment of the present invention, a plurality of print heads are coupled to the frame for movement relative thereto, across the web. Preferably, the print heads are staggered relative to one another, such that the swath height scanned in a single traverse of the scan segment is a function of the number of print heads mounted to the frame.

The present invention also resides in a method for printing on a continuously advancing web of work material wherein a printing apparatus as described herein-above is provided. The apparatus includes a controller for storing data therein corresponding to a graphic to be printed. During operation, the web is continuously advanced in the X coordinate direction at the velocity $v_{ax}$ relative to the frame. The source array is moved relative to the frame along the scan segment at a velocity $v_a$ related to the web velocity $v_{wx}$ such that as the scanning array traverses the scan segment, the array has first velocity component $v_{ax}$ in the X coordinate direction equal to $v_{wx}$, and a second velocity component $v_{ay}$ in the Y coordinate direction. Therefore, the source array in traversing the scan segment of the path scans and prints a swath on the web parallel to the Y coordinate direction having a swath height $h_s$, in response to commands issued from the controller.

The movement of the source array along the scan segment in the X coordinate direction is such that in the time required for moving the source array along the full extent of the scan segment the web advances a distance $h_w$ in the X coordinate direction that is less than the swath height $h_s$. Upon traversing the full extent of the scan segment, the source array immediately moves along a repositioning segment after traversing the full extent of the scan segment such that prior or equal to a time taken for the web to advance a distance d, where $d=h_s-h_w$. Accordingly, the print head is once again positioned for immediate movement along the scan segment.

The movement of the source array along the scan and repositioning segments is repeated causing successive adjacent swaths to be scanned and printed on the continuously advancing web parallel to the Y coordinate direction in response to commands issued from the controller.

DETAILED DESCRIPTION OF THE PREFERRED EMBODIMENTS OF THE PRESENT INVENTION

Figure 1:
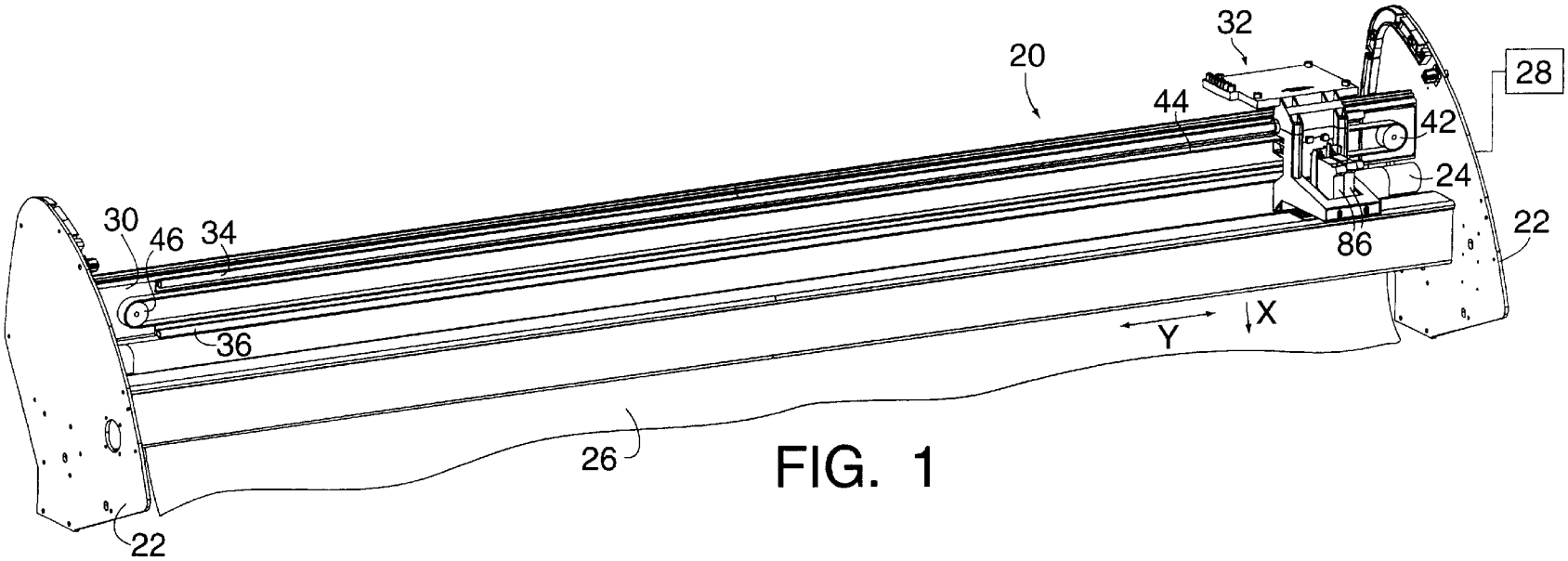
FIG. 1 is a partial perspective view of an embodiment of the apparatus of the present invention for printing onto a continuously advancing web of work material.
Figure 2:
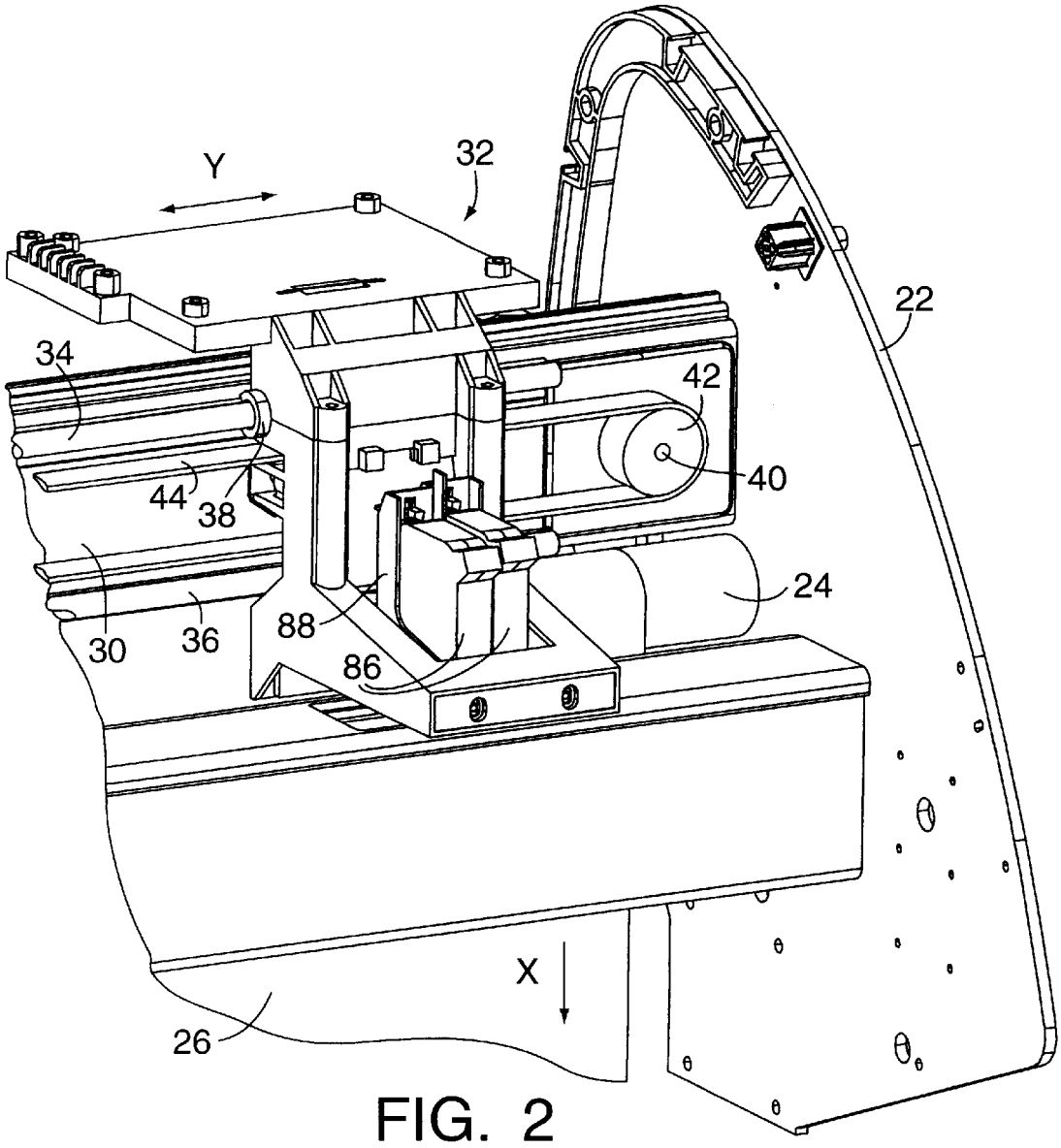
FIG. 2 is an enlarged perspective view of the apparatus of FIG. 1 showing the print head carriage coupled for movement to the frame and the web being continuously advanced through the apparatus.

As shown in FIGS. 1 and 2, an embodiment of the apparatus of the present invention is generally designated by the reference numeral 20. The apparatus 20 includes a frame 22 having a roller 24 rotatably coupled thereto for supporting and continuously advancing a web of work material 26 through the apparatus longitudinally of itself in a first coordinate direction as indicated by the arrow labeled "X." To continuously advance the web, the roller 24 is driven by suitable means, such as, but not limited to a motor (not shown). The motor is responsive to commands issued from a programmable controller 28 coupled to the apparatus 20 and having data corresponding to a graphic to be printed onto the web 26, stored therein in a machine readable format.

As shown in FIG. 2, an elongated carriage support 30 is mounted to the frame 22 and extends along the length of the roller 24 approximately parallel thereto. A print head carriage 32 is slidably coupled to the carriage support 30 via upper and lower rails 34 and 36 respectively. The upper and lower rails, 34 and 36 are attached to the carriage support 30 and are approximately parallel to one another as well as to the roller 24. The upper rail 34, and the lower rail 36 each extend through a bushing 38 (only one shown) mounted on the print head carriage 32. During operation, the print head carriage 32 slides back-and-forth along the upper and lower rails in the Y coordinate direction in response to commands issued from the controller 28. To allow the print head carriage 32 to slide smoothly along the upper and lower rails 34 and 36, the bushings 38 must be made of a suitable material, such as, but not limited to polytetrafluoroethylene. Moreover, while bushings 38 have been shown and described, the present invention is not limited in this regard as other components known to those skilled in the pertinent art to which the present invention pertains, such as linear roller-type bearings, may be substituted without departing from the broader aspects of the present invention.

Referring to FIGS. 1 and 2, a stepper motor (not shown) is mounted to a back side of the carriage support 30 at a first end thereof, and includes a rotatable shaft 40 extending through the carriage support. A first pulley 42 is mounted on the shaft 40 and drivingly engages belt 44. A second pulley 46 is rotatably mounted to the carriage support at a second end thereof and also engages the belt 44. As will be explained in detail herein below, the belt 44 is attached at its ends to the print head carriage 32. Preferably, the belt 44 is a timing belt having a plurality of equally spaced teeth along its length, and the first and second pulleys 44 and 46 are timing pulleys each defining a plurality of circumferentially spaced mating teeth adapted to engage the teeth on the timing belt. However, the present invention is not limited in this regard as other types of belts and pulleys known to those skilled in the pertinent art to which the present invention pertains, such as V-belts and sheaves, may be substituted without departing from the broader aspects of the present invention.

Figure 3:
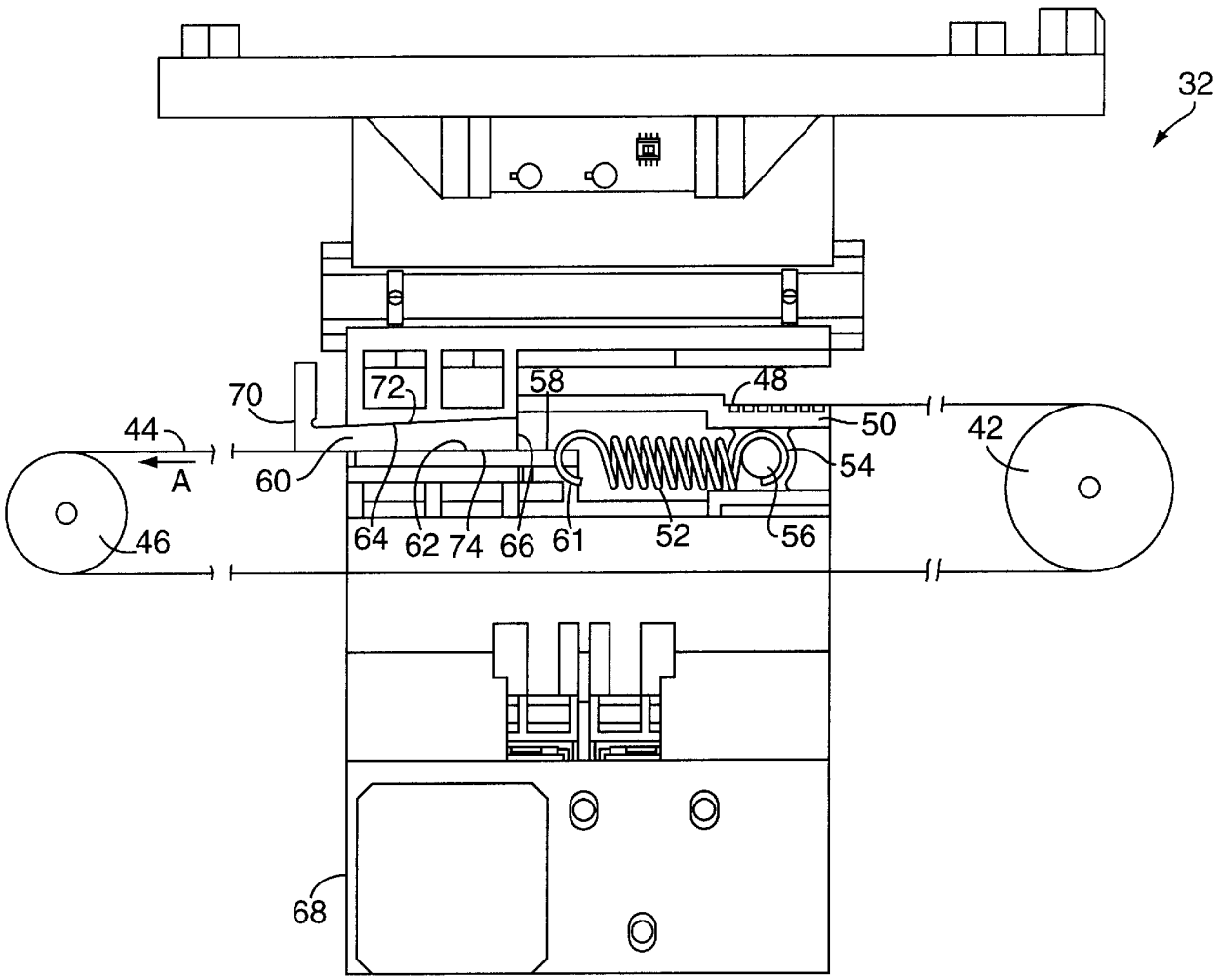
FIG. 3 is a partially schematic top view of the print head of FIG. 2, showing the manner in which a timing belt, is attached to the print head carriage, for driving the print head carriage across the apparatus of FIG. 1.

As shown in FIG. 3, the belt 44 engages the pulleys 40 and 42 and is attached at a first end 48 to one side of the print head carriage 32 via clamp 50. A coil spring 52 is mounted via first hooked end 54 onto a protrusion 56 extending from the print head carriage 32. A second end 58 of the belt 44 extends through a channel 60 located on the print head carriage 32 opposite to the clamp 50 and is retained by a second hooked end 61 defined by the spring 52. The length of the belt 44 being such that mounting the belt to the second hooked end of the spring 52 causes the spring to extend, thereby exerting a tensioning force on the belt.

Still referring to FIG. 3, the channel 60 includes opposed walls 62 and 64 with wall 64 progressively tapering from a first end 66 of the channel 60 towards an outside wall 68 of the print head carriage 32. A retaining member 70 is slidably positioned in the channel 60 and includes a first surface 72 defining a taper adapted to mate with the taper on the wall 64. The retaining member 70 also defines a second surface 74 opposite to the first surface and adjacent to the belt 44. In this configuration, the retaining member 70 slides along the tapered wall 64 of the channel 60 thereby releasably locking the belt 44 in place when a force is exerted thereon in the direction indicated by the arrow "A", thereby preventing any slack in the belt, or loosening during operation.

Figure 4:
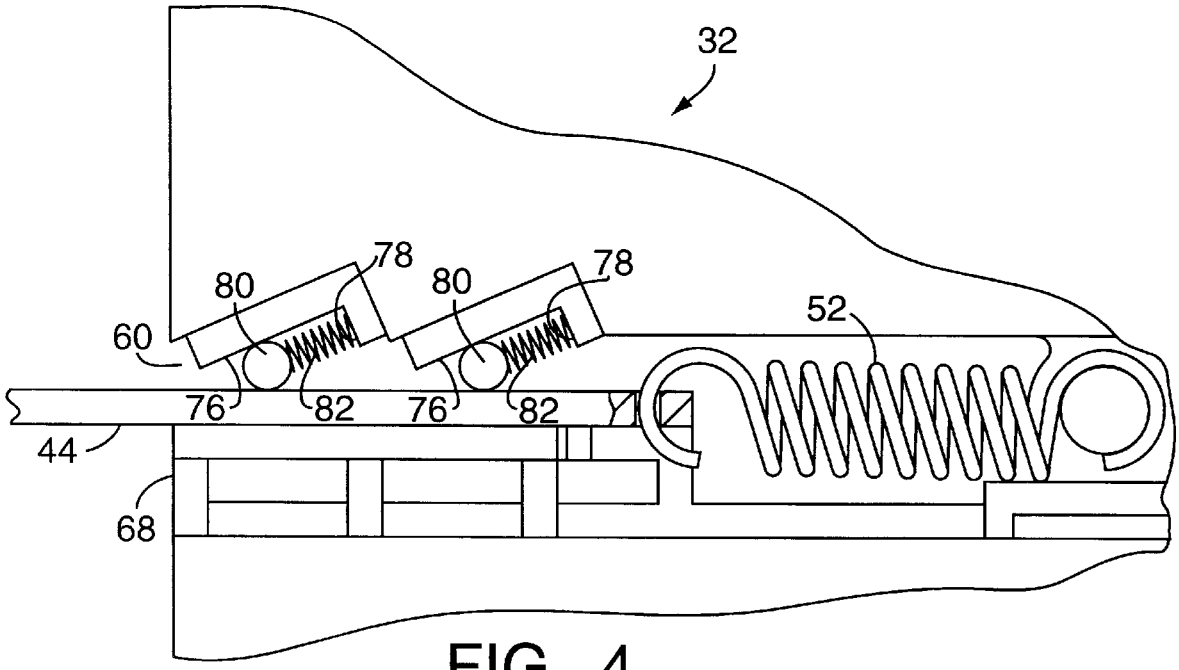
FIG. 4 is a partial top view of the print head of FIG. 2, showing an alternate manner of attaching the timing belt to the print head carriage.
Figure 5:
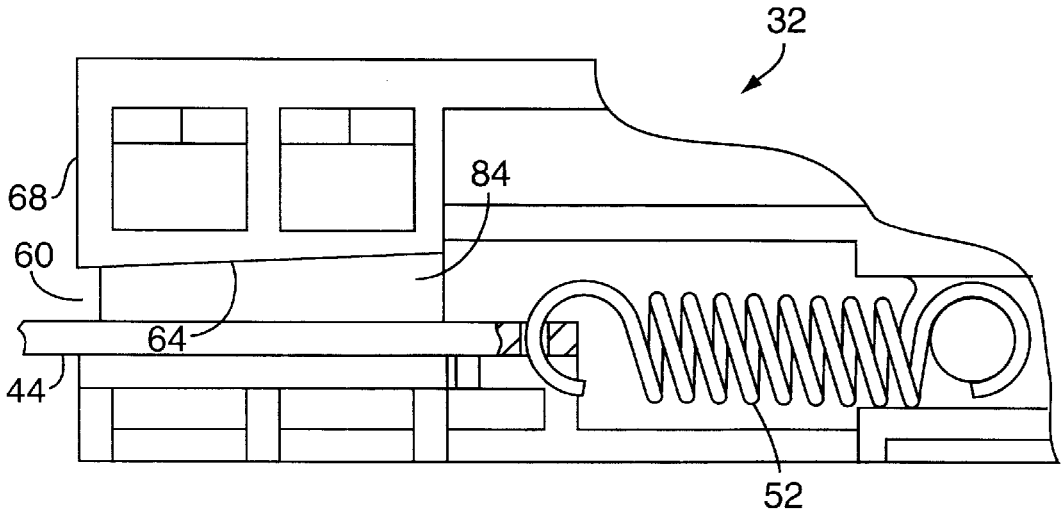
FIG. 5 is a partial schematic top view of the print head of FIG. 2, showing an alternate manner of attaching the timing belt to the print head carriage.

Alternatively, and as shown in FIG. 4, instead of employing a retaining member 70 as described above, the channel 60 can include a pair of tapered walls 76 aligned with one another, each defining a lip 78 projecting therefrom. A ball 80 is positioned between each wall 78 and the belt 44, with a spring 82 interposed between each ball and lip for biasing the balls against the belt. Accordingly, during operation the spring 52 will exert tension on the belt 44 while the spring loaded balls 80 will prevent the belt from loosening, by becoming wedged between the tapered walls 76 and the belt 44 releasably locking the belt in place. While spring loaded balls have been shown and described, the present invention is not limited in this regard as other components such as a spring loaded wedge 84, as shown in FIG. 5 can be substituted without departing from the broader aspects of the present invention.

Figure 6:
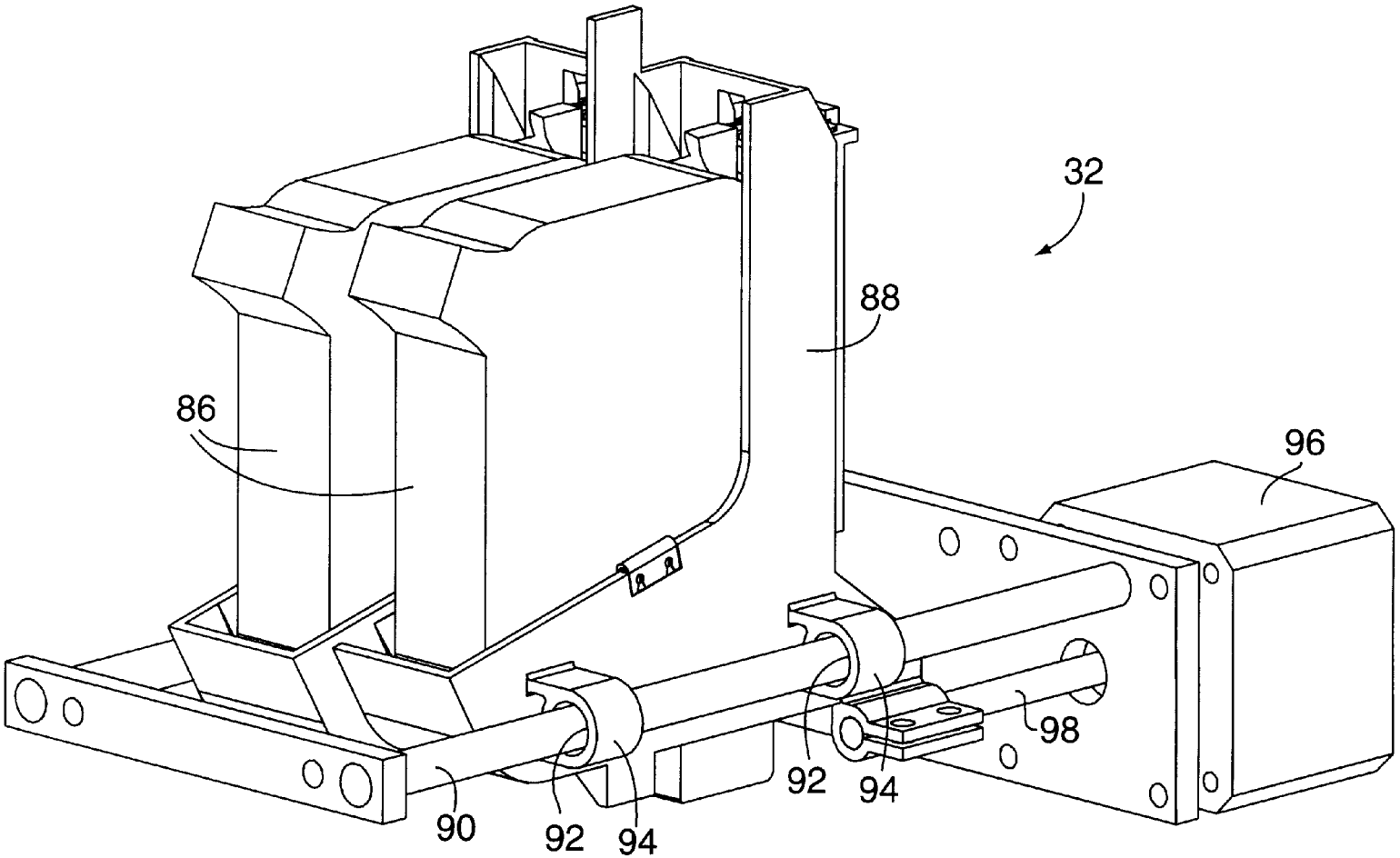
FIG. 6 is an enlarged perspective view of the print head carriage of FIG. 1, showing a pair of print heads in a partially forward position.

As shown in FIG. 6, the print head carriage 32 includes two print heads 86 releasably mounted to a carrier 88 which in turn is slidably mounted to the carriage via a pair of rails (one shown) 90. The rails 90 project outwardly from the print head carriage 32 each extending through a pair of apertures 92 defined by bosses 94 outwardly depending from the carrier 88. An actuator 96 is mounted to the print head carriage 32 and includes an actuating member 98 that extends through the print head carriage and engages the carrier 88. Preferably, the actuator 96 is a stepper motor, and the actuating member 98 is a lead screw rotatably coupled to the stepper motor. Upon rotation of the lead screw, the carrier 88 and print heads 86 move between a forward and rearward position in response to commands issued from the controller 28, FIG. 1. However, the present invention is not limited in this regard as other types of actuators, and actuating members known to those skilled in the pertinent art to which the present invention pertains, such as a pneumatic cylinder having an extendible cylinder rod, can be substituted without departing from the broader aspects of the present invention. In addition, while the illustrated embodiment shows two print heads 86, the present invention is not limited in this regard as one, or a plurality of print heads staggered relative to one another can also be employed.

Figure 7:
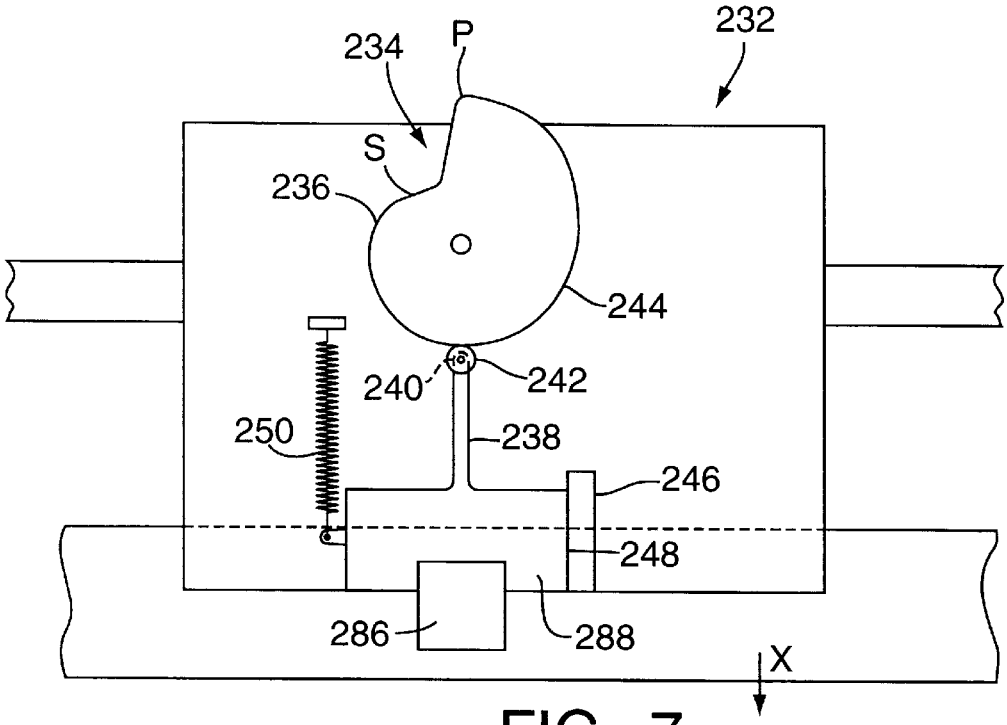
FIG. 7 is a partial front view of an embodiment of the print head carriage showing a cam mechanism for moving the print head between a forward and a rearward position.

A second embodiment of the print head carriage of the present invention is shown in FIG. 7 and generally designated by the reference numeral 232 and is similar in many respects to the print head carriage 32 described above. Therefore, like reference numerals preceded by the number 2 are used to indicate like elements. The print head carriage 232 differs from the print head carriage 32 in that instead of an actuator and actuating member, the print head is moved between the forward and rearward positions via a cam mechanism 234.

The cam mechanism 234 includes a cam 236 mounted to the print head carriage 232 and rotatable by a suitable drive, such as but not limited to a stepper motor (not shown). A carrier 288 having a print head 286 releasably mounted thereon, is slidably coupled to the print head carriage 232 for movement between a forward and a rearward position. The carrier 288 includes an extension 238 projecting therefrom and having an end 240 to which a wheel 242 is rotatably mounted and engages a peripheral surface 244 defined by the cam 236. A guide 246 extends form the print head carriage 232 and slidably engages an edge 248 of the carrier 288 to maintain the alignment of the carrier during movement between the forward and rearward position. A biasing member, shown in the illustrated embodiment as a spring 250 is mounted at one end to the carrier 288 and at an opposite end to the print head carriage 232 for urging the carrier to the rearward position. During operation, as the cam 234 rotates, the carrier 288 and thereby the print head 286 moves from the rearward toward the forward position until such time as the wheel 242 encounters the point labeled "P", FIG. 7. At this point, the force exerted on the carrier 288 by the spring 250 causes the carrier 288 to return to the rearward position, and the wheel 242 to engage the surface labeled "S".

Figure 8:
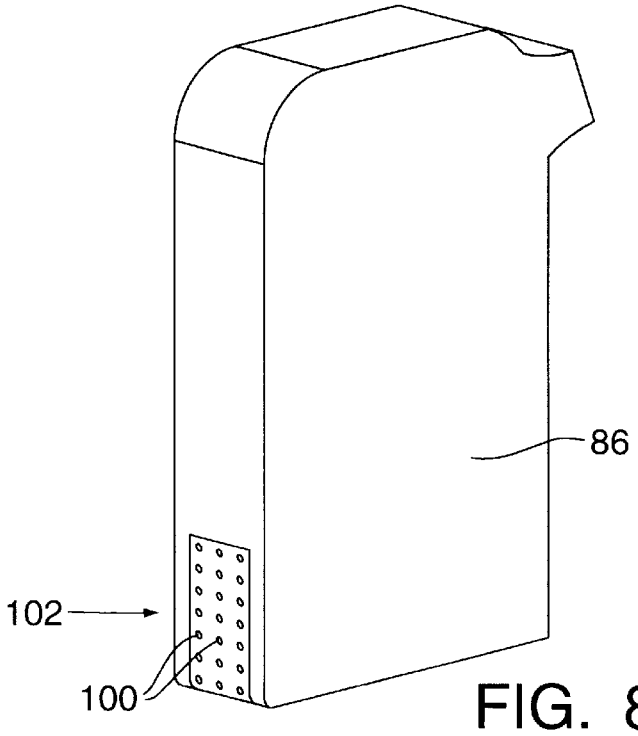
FIG. 8 is a perspective view of one of the print heads of FIG. 6 showing an array of printing elements.

As shown in FIG. 8, each print head 86, FIG. 1, or 286, FIG. 2, includes a plurality of discrete print elements 100 arranged in a matrix-like source array 102. The print elements 100 are in communication with an ink reservoir (not shown) so that during operation, as the print head carriage 32, FIGS. 1 and 2, or 232, FIG. 7 traverses the web 26, ink is transferred via the source array 102 of print elements 100 onto the web in response to commands issued from the controller 28. While an ink-jet-type print head has been shown and described, the present invention is not limited in this regard as other print heads known to those skilled in the pertinent to which the invention pertains, such as dot matrix or thermal print heads may be substituted without departing from the broader aspects of the present invention.

Referring to FIGS. 1 and 2, as well as to FIG. 9, the operation of the apparatus 20 will be explained in detail. During operation, while the web 26 is continuously advanced in the X direction at a velocity $v_{wx}$ the belt 44 causes the print head carriage 32, and thereby the source array 102 to repetitively traverse the web 26 in response to commands issued from the controller 28. While the print head carriage 32 traverses the web 26, the actuator 96 causes the carrier 88 and thereby the print heads 86 to move between the rearward and forward positions.

Figure 9:
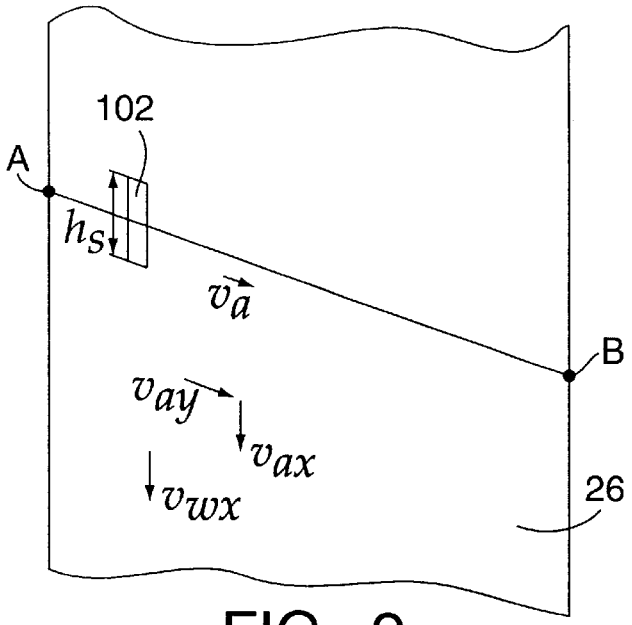
FIG. 9 is a schematic view of a path followed by the print head, relative to the frame, during operation of the apparatus of FIG. 1.
Figure 10:
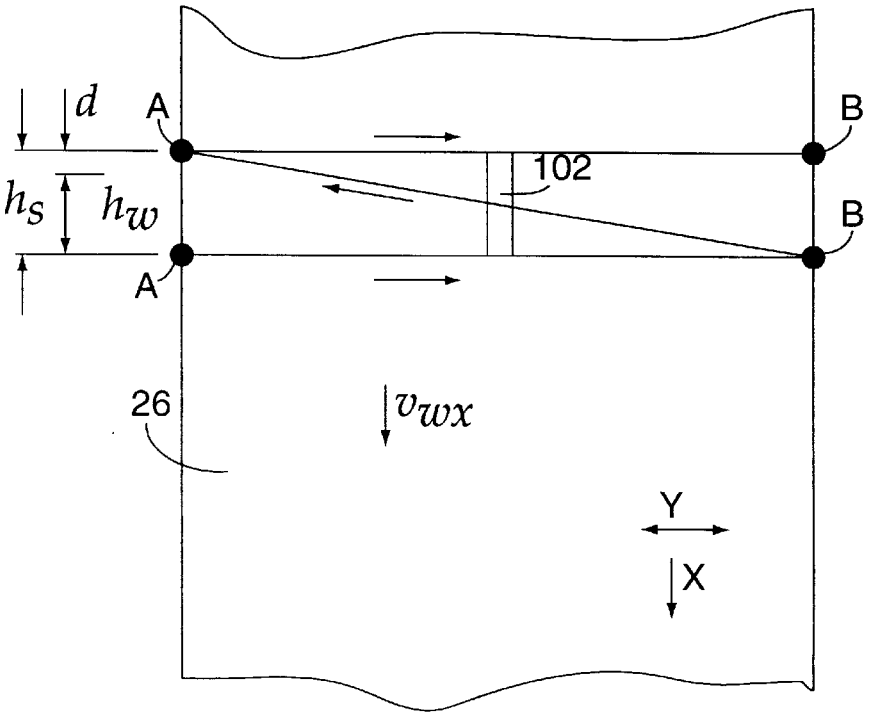
FIG. 10 is a schematic view of the path followed by the print head of FIG. 9 relative to the continuously advancing web.

Referring to FIG. 9 the above-described motion causes the print heads 86 and thereby the source array 102, FIG. 7 to trace a path across the web 26 relative to the frame, that includes a scan segment extending from the point labeled A to the point labeled B, and a repositioning segment extending from points B to A. The scanning array 102 traverses the scan segment from point A to point B at an overall velocity $v_a$. The velocity $v_a$ has first and second velocity components in the X and Y coordinate directions, $v_{ax}$ and $v_{ay}$ respectively, where $v_{ax}$ is the velocity at which the actuator 96 moves the carrier 88 from the rearward toward the forward position in the X coordinate direction and is equal to the velocity of the continuously advancing web $v_{wx}$. Accordingly, and as best seen in FIG. 10 which depicts the path followed by the source array 102 relative to the web 26, the source array in traversing the scan segment AB scans a swath on the web parallel to the Y coordinate direction and having a swath height $h_s$.

Referring back to FIG. 9, the second velocity component corresponds to the rate at which the print head carriage 232 moves across the web 26 in the Y coordinate direction and is such that in the time required for moving the scanning array 102 along the full extent of the scan segment AB the web 26 advances a distance $h_w$ in the X coordinate direction that is less than the swath height $h_s$. Upon traversing the scan segment AB the source array 102 travels along the repositioning segment BA such that prior or equal to a time taken for the web 26 to advance a distance d, where $d=h_s-h_w$, the source array 102 is repositioned for immediate movement along the scan segment AB. Referring once again to FIG. 10, as the above-described process is repeated and the web 26 is continuously advanced in the X coordinate direction, successive swaths of the web are scanned by the source array 102 parallel to the Y coordinate direction and immediately adjacent to one another. As these successive swaths are scanned the desired graphic is printed on the web 26 in response to commands issued from the controller 28.

While the operation of the apparatus 20 has been described above with reference to the print head carriage 32 as shown in FIGS. 1 and 2, the description is also applicable to the print head carrier 232, shown in FIG. 7. The difference being that instead of the lead screw 98 being employed to advance the carrier 88, the cam 236 engages the carrier 288 and advances the print head 286 between the rearward and forward positions at the velocity $v_{ax}$.

Alternatively, a scanning array of print elements can be selected from the source array 102, such that during operation as the print head traverses the web 26 along a scan segment AB, groups of printing elements comprising the scanning array are selectively activated causing the scanning array to move across the source array 102, in the X coordinate direction at a velocity $v_{ax}$, relative to the frame 22 and equal to the web velocity $v_{wx}$.

While the motion of the print head 86 and thereby the source array of printing elements 102 has been illustrated in FIGS. 9 and 10 as being back-and-forth along the line segment defined by points A and B, the present invention is not limited in this regard as the print head 86 can trace other paths relative to the frame 22. For example, and as schematically illustrated in FIGS. 11 and 12, the source array 102 can follow a figure-8-shaped path consisting of first and second scan segments AB and CD respectively, and first and second repositioning segments BC and DA respectively.

During operation of the apparatus 20, the source array 102 initially traverses the first scan segment AB from the first end labeled A to the second end labeled B at a velocity $v_{1a}$ having a first velocity component $v_{1ax}$ in the X coordinate direction equal to the velocity of the web $v_{wx}$, and a second velocity component $v_{1ay}$ in the Y coordinate direction. Accordingly, the source array scans a first swath on the web parallel to the Y coordinate direction having a first swath height $h_{1s}$.

As the source array traverses the first scan segment, the second velocity component $v_{1ay}$ is such that in the time required for the array to traverse the full extent of the first scan segment, the web advances a distance $h_{1w}$ in the X coordinate direction that is less than the swath height $h_{1s}$. Upon traversing the full extent of the first scan segment the source array next traverses the first repositioning segment from point B to point C in a time less than or equal to the time taken for the web to advance a distance $d_1$, where $d_1=h_{1s}-h_{1w}$. The print head is now positioned for immediate movement along the second scan segment CD.

Figure 11:
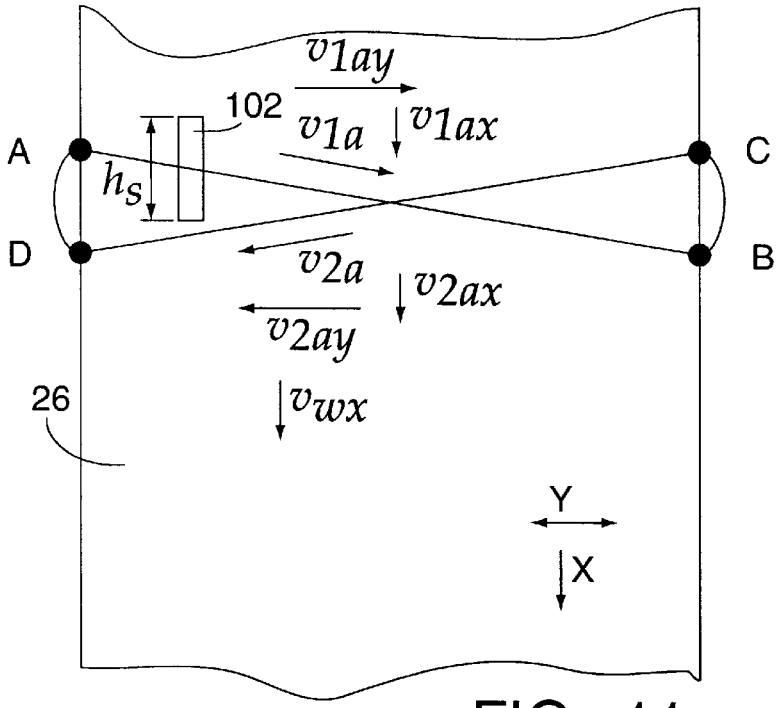
FIG. 11 is a schematic view of an alternate path followed by the print head, relative to the frame, during operation of the apparatus of FIG. 1.
Figure 12:
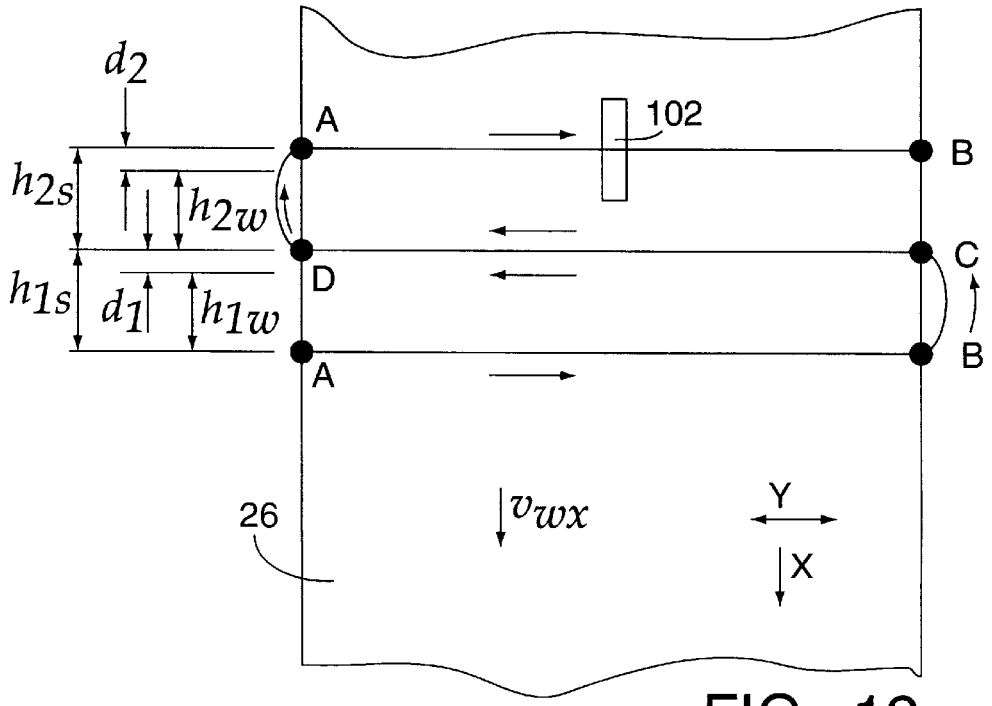
FIG. 12 is a schematic view of the path followed by the print head of FIG. 11 relative to the continuously advancing web.

Still referring to FIG. 11, the source array next traverses the second scan segment at a velocity $-v_{2a}$ defined by a first velocity component $v_{2ax}$ in the X coordinate direction equal to the velocity of the web $v_{wx}$, and a second velocity component $-v_{1ay}$. In traversing the second scan segment from point C to point D, the source array scans a second swath on the web parallel to the Y coordinate direction, having a second swath height $h_{2s}$. Moreover, the velocity component $-v_{2ay}$ is such that in the time required for the scanning array to traverse the full extent of the second scan segment the web advances the distance $h_{2w}$ in the X coordinate direction which is less than the second swath height space $h_{2s}$.

Accordingly, upon traversing the full extent of the second scan segment the source array travels along the second repositioning segment from point D to point A in a time less than or equal to the time taken for the web to advance a distance $d_2$, where $d_2=h_{2s}-h_{2w}$. In this manner the print head is once again positioned for immediate movement along the first scan segment, such that the path traced by the source array is figure-8-shaped relative to the frame.

As shown in FIG. 12, when the figure-8-shaped path of FIG. 11 is viewed relative to the continuously advancing web 26, the source 102 array scans two successive swaths of said continuously advancing web immediately adjacent to one another and parallel to the Y coordinate direction, with each traverse of the figure-8-shaped path. The source array 102 will transfer swaths of print corresponding to the desired graphic, onto the web 26 in response to commands issued from the controller 28, FIG. 1.

While the present invention has been shown and described in FIGS. 9–12 as involving the movement of the entire source array 102 in the X direction to achieve the velocity components $v_{ax}$, $v_{1ax}$ and $-v_{2ax}$ that are equal to the web velocity $v_{wx}$, the present invention is not limited in this regard. For example, and referring to FIG. 8, a scanning array 104 that comprises a portion of the source array 102 can be selectively activated in response to commands issued from the controller 28. During operation, as the print head 86 traverses a scan segment on the web 26, the scanning array 104 shifts along the source array 102, in the X coordinate direction at the velocity $v_{ax}$, $v_{1ax}$ or $-v_{2ax}$. Accordingly, the scanning array scans successive swaths on the web 26 parallel to the Y coordinate direction and immediately adjacent to one another.

While the source array 102 has been illustrated as traversing the entire width of the web 26, the present invention is not limited in this regard. Depending on the graphic being printed, the source array 102 may only need to traverse a portion of the web's width. In addition, the web velocity $v_{wx}$ can vary depending on the complexity of the graphic being printed and/or the width of the web 26. The velocity $v_{wx}$ can also vary depending on the speed at which the controller 28, FIG. 1 can process the data corresponding to the graphic being printed. The velocity of the print head carriage 32, FIG. 1, or 232, FIG. 7 and thereby the source array 102 can be adjusted to compensate for changes in the web velocity $v_{wx}$ in response to commands issued from the controller.

Figure 13:
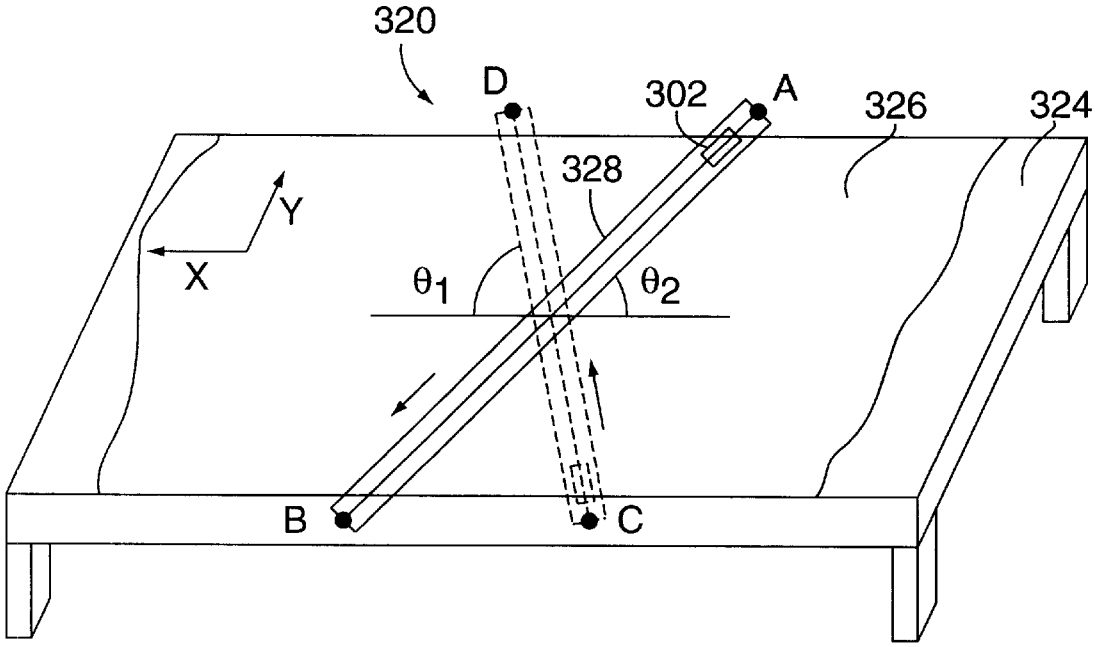
FIG. 13 is a partially schematic perspective view of an alternate embodiment of the apparatus of FIG. 1, showing a flat-bed -type printing device.

FIG. 13 illustrates an alternate embodiment of the apparatus of the present invention that includes many of the same features as the apparatus 20. Accordingly, like elements will be designated by the same element numbers preceded by the numeral 3. While the apparatus 20, FIG. 1 has been shown and described as including a roller 24 that defines a support surface for the advancing web 26, the present invention is not limited in this regard. As shown in FIG. 13, a flat-bed type printer 320 having a substantially flat work support surface 324 can also be employed with the source array 302 traversing the web 326 in the same manner and along the same paths as described herein-above.

Alternatively and as shown in FIG. 13, the above described figure-8-shaped path can be traced by employing a print head carriage support 326 pivotally coupled to the apparatus 320 for movement between a first angle $\phi_1$ relative to the X coordinate direction and a second angle $\phi_2$, equal and opposite to the first angle. During operation, the source array 302 travels along the carriage support 326 oriented at the angle $\phi_1$. Upon reaching the end of the first scan segment the carriage support pivots to the angle $\phi_2$, thereby positioning the source array 302 to traverse the second scan segment. This process is repeated until the desired graphic is printed onto the continuously advancing web.

While preferred embodiments have been shown and described, various modifications and substitutions may be made without departing from the spirit and scope of the invention. Accordingly, it is to be understood that the present invention has been described by way of example, and not by limitation.

What is claimed is:

1. An apparatus for printing on a continuously advancing web of work material comprising:

a frame;

means for continuously advancing said web in an X coordinate direction longitudinally of itself at a velocity $v_{wx}$ relative to said frame;

at least one print head coupled to said frame for movement relative thereto, said print head including a plurality of print elements arranged in a scanning array extending in said X coordinate direction;

means for repetitively moving said scanning array relative to said frame along a path including at least one scan segment and at least one repositioning segment at such a velocity $v_a$ related to said web velocity $v_{wx}$ that as said scanning array traverses said scan segment of the path said scanning array has a first velocity component $v_{ax}$ in said X coordinate direction, and a second velocity component $v_{ay}$ in a Y coordinate direction perpendicular to said X coordinate direction;

said means for repetitively moving said scanning array of print elements further being such that said first velocity component $v_{ax}$ is equal to $v_{wx}$ so that said scanning array in traversing said scan segment of the path scans a swath on said web parallel to said Y coordinate direction and having a swath height $h_s$;

said means for repetitively moving said scanning array of print elements further being such that said second velocity component $v_{ay}$ is such that in the time required for moving said scanning array along the full extent of said scan segment of the path said web advances a distance $h_w$ in said X coordinate direction that is less than said swath height; and wherein upon traversing said scan segment said scanning array travels along said repositioning segment such that prior or equal to a time taken for said web to advance a distance d, where $d=h_s-h_w$, said print head is repositioned for immediate movement along a scan segment thereby causing successive swaths of said web scanned by said scanning array to be positioned on said continuously advancing web immediately adjacent to one another.

2. An apparatus for printing on a continuously advancing web of work material as defined by claim 1, wherein said velocity $v_{wx}$ is constant.

3. An apparatus for printing on a continuously advancing web of work material as defined by claim 1, wherein said velocity $v_{wx}$ varies in dependence on a width defined by said web.

4. An apparatus for printing on a continuously advancing web of work material as defined by claim 1, wherein said at least one print head is an ink-jet print head.

5. An apparatus for printing on a continuously advancing web of work material as defined by claim 1, wherein said at least one print head is a thermal print head.

6. An apparatus for printing on a continuously advancing web of work material as defined by claim 1, wherein said at least one print head is a dot matrix print head.

7. An apparatus for printing on a continuously advancing web of work material as defined by claim 1 further comprising:

a programmable controller for storing data corresponding to a graphic to be printed onto said web, and for issuing command signals to said means for continuously advancing said web, said print head, and said means for repetitively moving said scanning array of print elements, to print said graphic onto said web.

8. An apparatus for printing on a continuously advancing web of work material as defined by claim 7 wherein said print head includes a source array of printing elements and said scanning array is selected from said source array in a such a manner as to cause said scanning array to have said velocity $v_{ax}$.

9. An apparatus for printing on a continuously advancing web of work material as defined by claim 7 wherein said velocity $v_{wx}$ varies with time in response to commands issued from said controller depending on the complexity of said graphic stored in said controller and said controller's ability to process said data corresponding to said graphic.

10. An apparatus for printing on a continuously advancing web of work material as defined by claim 7 wherein said scan segment has a length which varies in dependence on said graphic being transferred onto said web.

11. An apparatus for printing on a continuously advancing web of work material as defined by claim 7 wherein:

said means for continuously advancing said web in said X coordinate direction longitudinally of itself at a velocity $v_{wx}$ relative to said frame includes a roller mounted for rotation to said frame, for supporting and advancing said web; and drive means for continuously rotating said roller at a rate sufficient to impart said velocity $v_{wx}$ to said web, in response to commands issued from said controller.

12. An apparatus for printing on a continuously advancing web of work material as defined by claim 11 wherein said drive means is a motor coupled to said roller.

13. An apparatus for printing on a continuously advancing web of work material as defined by claim 11, further comprising;

an elongated carriage support attached to said frame adjacent and approximately parallel to said roller;

a print head carriage coupled to said carriage support for movement in said Y coordinate direction;

second drive means for moving said print head carriage along said carriage support in response to commands issued from said controller;

said print head being slidably mounted to said print head carriage; and an actuator coupled to said print head for moving said print head in said X coordinate direction at a rate equal to said velocity component, in response to commands issued from said controller.

14. An apparatus for printing on a continuously advancing web of work material as defined by claim 13 wherein said actuator is a servo.

15. An apparatus for printing on a continuously advancing web of work material as defined by claim 13 wherein said actuator is a stepper motor.

16. An apparatus for printing on a continuously advancing web of work material as defined by claim 13 wherein said actuator is a cam.

17. An apparatus for printing on a continuously advancing web of work material as defined by claim 1 further comprising:

a print head carriage coupled to said frame for movement in said Y coordinate direction at a rate equal to said velocity component $v_{ay}$; and wherein said print head is mounted to said print head carriage for movement in said X coordinate direction relative to said frame at a rate equal to said velocity component $v_{ax}$.

18. An apparatus for printing on a continuously advancing web of work material as defined by claim 1, further comprising:

a plurality of print heads each including a plurality of print elements arranged in a scanning array extending in said X coordinate direction perpendicular to said Y coordinate direction, said print heads being coupled to said frame in a staggered relationship relative to one another; and wherein as said plurality of print heads transverse said scan segment of the path, said swath scanned on said web parallel to said X coordinate direction has an effective swath height $h_s$ that is a function of the combined scanning arrays of said plurality of print heads.

19. An apparatus for printing on a continuously advancing web of work material as defined by claim 1, wherein:

said means for continuously advancing said web in said X coordinate direction longitudinally of itself at a velocity $v_{wx}$ relative to said frame includes a substantially flat web support surface over which said web is advanced.

20. An apparatus for printing on a continuously advancing web of work material as defined by claim 1, wherein:

said path includes a first scan segment having first and second ends, and a second scan segment having third and fourth ends, each of said first and second scan segments extending transversely across said web;

said first scan segment being oriented at a first angle relative to said X coordinate direction;

said second scan segment being oriented at a second angle approximately equal and opposite to said first angle and having a third end adjacent to said second end of said first scan segment and a fourth end adjacent to said first end of said first scan segment wherein said at least one repositioning segment includes a first repositioning segment and a second repositioning segment;

said path further having said first repositioning segment extending between said first end of said first scan segment and said fourth end of said second scan segment, and said second repositioning segment extending between said second end of said first scan segment and said third end of said second scan segment, such that said scanning array in traversing said first scan segment of the path from said first to said second end has said first velocity component $v_{1ax}$ in said X coordinate direction, and said second velocity component $v_{1ay}$ in said Y coordinate direction and scans a first swath on said web parallel to said Y coordinate direction and having a first swath height $h_{1s}$;

said means for moving said scanning array of print elements further being such that:

said second velocity component $v_{1ay}$ is such that in the time required for moving said array along the full extent of said first scan segment of the path said web advances a distance $h_{1w}$ in said X coordinate direction that is less than said swath height $h_{1s}$;

upon traversing said first scan segment said scanning array travels along said first repositioning segment such that prior or equal to a time taken for said web to advance a distance $d_1$, where $d_1=h_{1s}-h_{1w}$, said print head is repositioned for immediate movement along said second scan segment;

said means for repetitively moving said scanning array of print elements relative to said frame further being such that:

as said scanning array traverses said second scan segment of the path said scanning array has said first velocity component $v_{2ax}$ in said X coordinate direction, and a third velocity component $-v_{2ay}$ in said Y coordinate direction equal in magnitude and opposite in direction to said second velocity component $v_{2ay}$;

said means for moving said array of print elements further being such that said third velocity component $v_{2ax}$ along said second scan segment is equal to $v_{wx}$ so that said scanning array in traversing said second scan segment of the path scans a second swath on said web parallel to said Y coordinate direction and having a second swath height $h_{2s}$;

said means for moving said scanning array of print elements further being such that:

said third velocity component $-v_{2ay}$ is such that in the time required for moving said scanning array along the full extent of second scan segment of the path said web advances said distance $h_{2w}$ in said X coordinate direction that is less than said second swath height $h_{2s}$; and wherein upon traversing said second scan segment said scanning array travels along said second repositioning segment such that prior or equal to a time taken for said web to advance a distance $d_2$, where $d_2=h_{2s}-h_{2w}$, said print head is repositioned for immediate movement along said second scan segment, such that said path is figure-8-shaped relative to said frame.

21. An apparatus for printing on a continuously advancing web of work material as defined by claim 1, wherein said print head includes a source array of elements and said scanning array is selected from said source array, such that said scanning array has said velocity $v_{ax}$.

22. A method for printing on a continuously advancing web of work material, said method comprising the steps of:

a. providing a printing apparatus having a frame, at least one print head coupled to said frame for movement relative thereto, said print head including a plurality of print elements arranged in a scanning array extending in an X coordinate direction, and a controller for storing data therein corresponding to a graphic to be printed;

b. continuously advancing said web in a X coordinate direction perpendicular to said Y coordinate direction, at a velocity $v_{wx}$ relative to said frame;

c. moving said scanning array of print elements relative to said frame along a scan segment at such a velocity $v_a$ related to said web velocity $v_{wx}$ that as said scanning array traverses said scan segment said scanning array has a first velocity component $v_{ax}$ in said X coordinate direction equal to $v_{wx}$, and a second velocity component $v_{ay}$ in said Y coordinate direction so that said scanning array in traversing said scan segment of the path scans a swath on said web parallel to said Y coordinate direction and having a swath height $h_s$;

d. further moving said scanning array of print elements such that said velocity component $v_{ax}$ is such that in the time required for moving said scanning array along the full extent of said scan segment said web advances a distance $h_w$ in said X coordinate direction that is less than said swath height $h_s$; and e. moving said scanning array along a repositioning segment after traversing the full extent of said scan segment such that prior or equal to a time taken for said web to advance a distance d, where $d=h_s-h_w$, said print head is repositioned for immediate movement along a scan segment f. repeating steps a through e thereby causing successive swaths of said web scanned by said array to be positioned on said continuously advancing web immediately adjacent to one another.

* * * * *

UNITED STATES PATENT AND TRADEMARK OFFICE

CERTIFICATE OF CORRECTION

PATENT NO. : 6,076,983

DATED : June 20, 2000

INVENTOR(S) : Stein et al.

It is certified that error appears in the above-identified patent and that said Letters Patent is hereby corrected as shown below:

Column 3, Line 15: After "where", delete "$d_{1s}$" and insert --$d_1$--.

Column 3, Line 65: After "velocity", delete "$v_{ax}$" and insert --$v_{wx}$--.

Column 9, Line 7: After "component", delete "$-v_{1ay}$" and insert -- $-v_{2ay}$--.

Signed and Sealed this

Third Day of April, 2001

*Attest:*

Nicholas P. Godici

NICHOLAS P. GODICI

*Attesting Officer*

*Acting Director of the United States Patent and Trademark Office*